US008176757B2

(12) United States Patent
Yoo et al.

(10) Patent No.: US 8,176,757 B2
(45) Date of Patent: May 15, 2012

(54) WASHING MACHINE

(75) Inventors: Sang Hee Yoo, Gyeongsangnam-do (KR); Jong Deuk Bae, Gyeongsangnam-do (KR); Kil Su Kim, Gyeongsangnam-do (KR); Ji Maeng Kim, Gyeongsanganm-do (KR); Young Bae Park, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 589 days.

(21) Appl. No.: 12/402,827

(22) Filed: Mar. 12, 2009

(65) Prior Publication Data

US 2009/0229320 A1 Sep. 17, 2009

(30) Foreign Application Priority Data

Mar. 13, 2008 (KR) ..... 10-2008-0023447

(51) Int. Cl.
*D06F 17/00* (2006.01)

(52) U.S. Cl. ..... 68/196

(58) Field of Classification Search ..... 68/196; 220/324, 315, 254.3, 254.1, 834, 833, 810; 312/228, 229

See application file for complete search history.

(56) References Cited

U.S. PATENT DOCUMENTS

| | | | | |
|---|---|---|---|---|
| 4,522,311 | A * | 6/1985 | Ikeda | 220/843 |
| 7,032,350 | B2 * | 4/2006 | Bienick et al. | 49/501 |
| 2004/0140628 | A1 * | 7/2004 | Haymond | 277/641 |
| 2004/0149749 | A1 * | 8/2004 | Lee et al. | 219/756 |
| 2004/0263032 | A1 * | 12/2004 | Cho | 312/330.1 |
| 2005/0044898 | A1 | 3/2005 | Park et al. | |
| 2006/0090523 | A1 | 5/2006 | Lyu | |
| 2006/0254323 | A1 | 11/2006 | Kim | |
| 2007/0017258 | A1 * | 1/2007 | Son et al. | 68/3 R |
| 2007/0268682 | A1 * | 11/2007 | Kim et al. | 362/92 |

FOREIGN PATENT DOCUMENTS

| | | | |
|---|---|---|---|
| JP | 10-057674 | A | 3/1998 |
| JP | 2001-252497 | A | 9/2001 |
| KR | 2001057909 | * | 7/2001 |
| KR | 10-2003-0037815 | A | 5/2003 |

OTHER PUBLICATIONS

English Machine Translation of abstract for KR 2001057909.*

* cited by examiner

*Primary Examiner* — Michael Kornakov
*Assistant Examiner* — Nicole Blan
(74) *Attorney, Agent, or Firm* — Birch, Stewart, Kolasch & Birch, LLP

(57) ABSTRACT

A washing machine includes a cabinet, a top cover provided at a top of the cabinet, and a lid hingedly coupled to the top cover, wherein the lid includes a transparent member defining a center thereof, a lower frame including a seating part where the transparent member is seated, and an upper frame coupled to the lower frame to support the transparent member.

15 Claims, 5 Drawing Sheets

WASHING MACHINE

CROSS REFERENCE TO RELATED APPLICATION

This application claims the benefit of the Patent Korean Application No. 10-2008-0023447, filed on Mar. 13, 2008, which is hereby incorporated by reference as if fully set forth herein.

BACKGROUND OF THE DISCLOSURE

1. Field of the Disclosure

The present invention relates to a washing machine. More particularly, the present invention relates to a washing machine capable of improving a structure of a lid closably coupled to a top cover and assembling efficiency thereof accordingly.

2. Discussion of the Related Art

Washing machines are electric home appliances which removes various contaminants attached to clothes, cloth items, beddings (hereinafter, laundry), using both friction of water currents generated by rotation of a pulsator and shock applied to laundry by the pulsator.

A conventional washing machine typically includes a cabinet, a top cover coupled to a top of the cabinet and a lid hingedly secured to the top cover to open and close an opening formed at the top cover.

The lid will be explained in detail. Such the lid defines a center of a top of the washing machine and it includes a transparent member, a lower frame and an upper frame. A user can look inside the tub of the washing machine through transparent member. And a seating part where the transparent member is seated may be formed at the lower frame and the upper frame is coupled to the lower frame to support the transparent member.

An assembly order of such the lid will be described.

The transparent member is seated on the seating part formed at the lower frame. Hence, the lower frame is coupled to the upper frame by a plurality of screws, covering the upper frame.

Once the upper frame and the lower frame are coupled each other by the screws, the transparent member is supported securely between the upper frame and the lower frame However, such the conventional lid may have following disadvantages.

The plurality of the screws should be provided to couple the upper and lower frames and productivity for assembling the lids would deteriorate because of increased assembly hour. In addition, production cost would be increased accordingly.

Furthermore, when opening and closing the lid, the transparent member contacts with the top cover and there might be scratches on the transparent member, which results in external beauty deterioration of the washing machine.

SUMMARY OF THE DISCLOSURE

Accordingly, the present invention is directed to a washing machine.

An object of the present invention is to provide a washing machine capable of improving a structure of a lid closably coupled to a top cover and assembling efficiency thereof accordingly.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a washing machine includes a cabinet; a top cover provided at a top of the cabinet; and a lid hingedly coupled to the top cover. Here, the lid includes a transparent member defining a center thereof, a lower frame including a seating part where the transparent member is seated, and an upper frame coupled to the lower frame to support the transparent member.

The lower frame may include a first hook projected upward and the upper frame may include a through hole where the first hook passes.

The first hook may include a supporting part extended upward from the lower frame and a hooking part provided at an end of the supporting part.

The hooking part may be spaced apart a predetermined distance from an upper end of the through hole when the first hook passes the through hole.

The washing machine may further include a frame deco secured to the upper frame such that the lid is balanced with the top cover when the lid is secured to the top cover.

The frame deco may include an engaging protrusion engaged to the first hook.

The thickness of the engaging protrusion may be substantially identical to the distance between the hooking part and the upper end of the through hole.

The frame deco may include a second hook projected downward and the upper frame may include a hooking hole where the second hook is insertedly hooked.

A handle may be provided at the lid for a user to rotate the lid with respect to the top cover.

The handle may include a recess formed at the upper case, a handle deco hooked to an upper portion of the recess and a steel deco secured to an upper portion of the handle deco.

Here, a handle deco seating part may be formed adjacent along the recess and a plurality of hook grooves may be provided at the handle deco seating part.

The handle deco may include a sliding hook sliding into the hook groove 312 and an elastic hook elastically transformed to be coupled to the hook groove.

Each of the plurality of the elastic hook grooves may include a sliding hook groove where the sliding hook is inserted and an elastic hook groove where the elastic hook is inserted.

The sliding hook may include a first extending part extended downward from the handle deco and a second extending part extended horizontally from the first extending part.

The elastic hook may include an elastic part extended downward from the handle deco and a hooking protrusion provided at an end of the elastic part, being hooked in the elastic hook groove.

The top cover may include a plurality of projections provided a predetermined portion thereof in contact with the lid when the lid is opened.

The projection may be semicircular shaped, in point contact with the lid when the lid is opened.

A protection surface may be formed at a predetermined portion of the transparent member which contacts with the top cover when the lid is opened.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
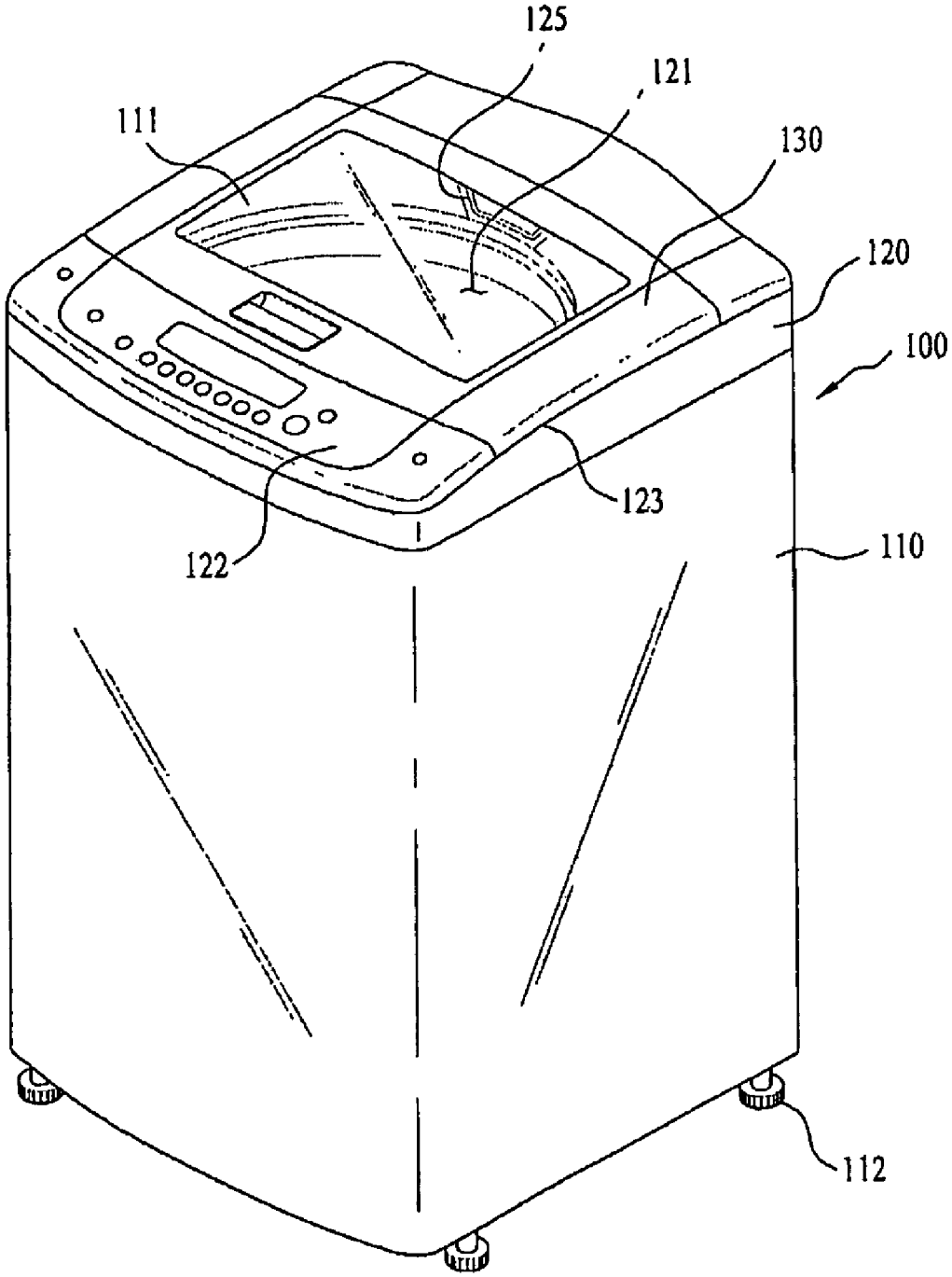
FIG. 1 is a perspective view illustrating a washing machine according to an exemplary embodiment of the present invention.

FIG. 1 is a perspective view schematically illustrating a washing machine according to an exemplary embodiment of the present invention.

As shown in FIG. 1, a washing machine 100 according to an exemplary embodiment of the present invention includes a cabinet 110, a top cover 120 and a lid 130. The cabinet 110 defines an exterior appearance of the washing machine and various parts of the washing machine 100 may be mounted in the cabinet 110. The top cover 120 is placed on a top of the cabinet 110. The lid 130 is rotatably coupled to the top cover.

A tub 111 is mounted in the cabinet 110 and laundry is received in the tub 111. Also, a leg 112 is supportedly provided at a lower surface of the cabinet 110 and the leg 112 prevents the washing machine 100 from slipping on the floor even while the washing machine is tumbling.

The top cover 120 includes an opening 121 and a control panel 122. The opening 121 is formed at a center of the top cover and a user may load the laundry into the tub 130 through the opening 121. The control panel 122 is provided on a predetermined portion of the top cover 120. At the control panel 122 are provided a display part displaying an operational state of the washing machine and a button part for the user to input a washing condition.

In addition, a detergent box 125 is provided at an inner rear surface of the top cover 120 to supply detergent or fabric softener to the laundry received in the tub 130 and the detergent box 125 is connected with a water supply hose such that the detergent received in the detergent box 125 and water may be mixedly supplied to the tub 140.

The lid 130 is installed on a top of the top cover 120. It is preferable that the lid 130 is hingedly coupled to the top of the top cover 120 to open and close the opening 121 formed at the top cover 120.

A lid seating part 123 is formed in the top cover 120 and the lid seating part 123 is recessed inward to a predetermined height for the lid 200 to be seated in. the height of the lid seating part 123 is substantially identical to the height of the lid 200. As a result, when the lid 200 is seated in the lid seating part 123, an upper surface of the top cover 120 and an upper surface of the lid 200 may be identically high to be level.

Figure 2:
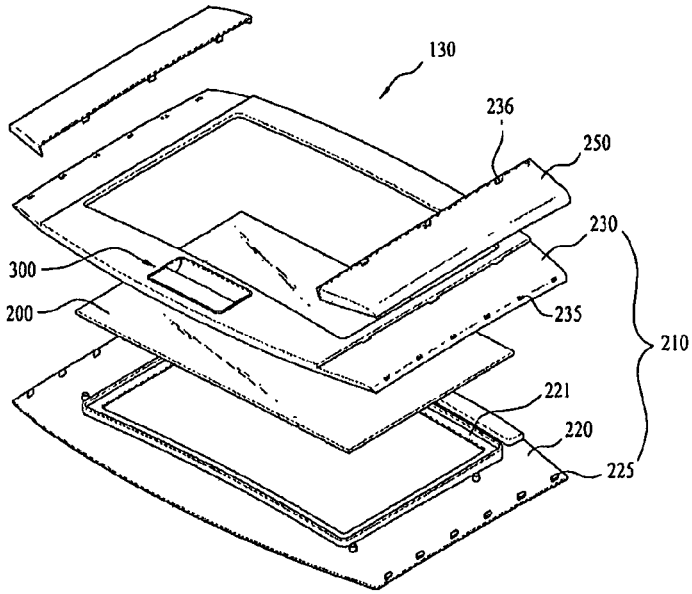
FIG. 2 is an exploded perspective view illustrating a lid provided in the washing machine shown in FIG. 1.
Figure 3:
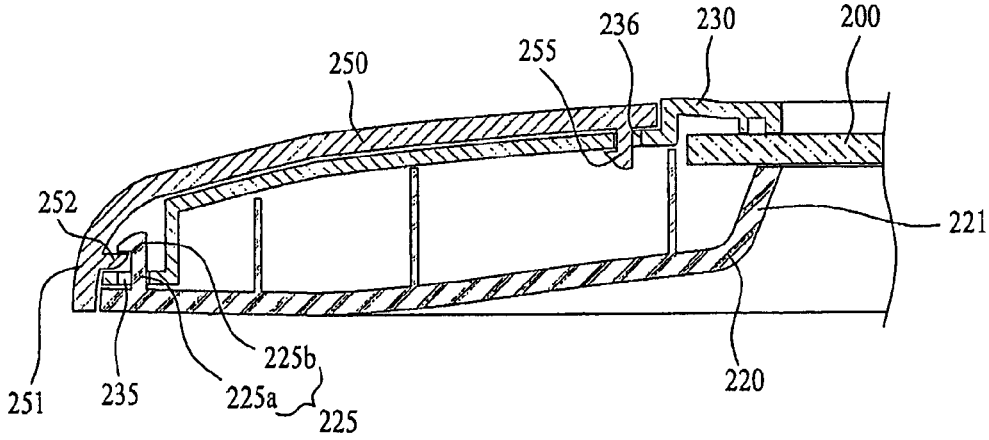
FIG. 3 is a sectional view illustrating the lid having been coupled.

FIG. 2 is an exploded perspective view of the lid 130 and FIG. 3 is a sectional view of the lid.

Next, in reference to FIGS. 2 and 3, the structure of the lid 130 will be explained.

The lid includes a transparent member 200 formed of transparent material, defining a center of the lid, and a frame 210 supporting the transparent member 200.

The frame 210 includes a lower frame 220 and an upper frame 230. The lower frame 220 is configured of an opening formed at a center thereof and a seating part 221 where the transparent member 200 is seated. The upper frame 230 is coupled to the lower frame 210 to support and transparent member 200.

The transparent member 200 allows the user to look into the tub 130 conveniently. The transparent member 200 has a convex shape with a bulging center portion and thus wash water dropped at an inner upper surface of the lid 130 can flow along a rim thereof.

The seating part 221 provided at the lower frame 220 may be formed of a rib extended toward an inside of the lower frame 220 to support the transparent member 200.

A frame deco 250 may be secured to each of both opposite ends of the upper frame 230 for the lid 130 to be balanced with the top cover, when seated in the lid seating part 123.

The lid 130 according to the present invention has a structure enabling the upper and lower frames 230 and 220 and the frame deco 230 to be coupled each other by using a hook, not using screws.

First hooks 225 may be projected upward from outer opposite end portions of the lower frame 220, and through holes may be formed at outer opposite end portions of the upper frame 230, respectively, corresponding to the first hooks 225. Then, the first hooks 225 passes the through holes, respectively.

It is preferable that the first hook 225 and the corresponding through hole 235 are provided in a forward and rearward direction in plural.

The first hook 225 includes a supporting part 225*a* extended upward from the lower frame 220 and a hooking part 225*b* provided at an end of the supporting portion 225*a*. the supporting part 225*a* is substantially higher than the through hole 235 such that the hooking part 225*b* is spaced apart a predetermined distance from an upper end of the through hole 235, when the first hook 225 passes through the through hole 235.

An extension 251 is provided at an outer end of the frame deco 250 and the extending is rounded downward to cover the sides of the lower and upper frames 220 and 230. In addition, an engaging protrusion 252 is provided an inner surface of the extension 251 and the engaging protrusion 252 is engaged to the first hook 225 provided at the lower frame 220. An upper surface of the engaging protrusion 252 is plane and a lower surface of the engaging protrusion 252 has curvature such that the engaging protrusion 252 may slide smoothly when engaged to the first hook 225. Here, the thickness of the engaging protrusion 252 is substantially identical to the distance between the hooking part 225*b* and the through hole 235.

Second hooks 255 are projected downward from an inner ends of the frame deco 250 and a hooking hole 236 is formed at an inner end of the upper frame 230, corresponding to the second hook 255. The second hook 255 is insertedly hooked in the hooking hole 236.

Next, a process of the securing operation between the lower frame 220 and the frame deco 250 will be described.

The transparent member 200 is seated in the seating part 221 of the lower frame 220 and the upper frame 230 covers the top of the lower frame 220. at this time, the first hook 225 provided at the lower frame 220 passes the through hole 235 formed at the upper frame 230 and then the hooking part 225*b* of the first hook 225 is spaced apart a predetermined distance from the through hole 235.

Hence, the second hook 255 formed at the frame deco 250 is insertedly hooked in the hooking hole 236 such that a corresponding side of the frame deco 250 may be secured to the upper frame 230. In this state, the outer end of the frame deco 250 is pushed and then the engaging protrusion 252 presses the upper portion of the first hook 225. As the lower surface of the engaging protrusion 252 and the upper surface of the hooking part 225*b* have curvatures, respectively, the engaging protrusion 252 pushes the hooking part 225*b* to the right side. As a result, the supporting part 225*a* of the first hook 225 is elastically moved to the right side and the engaging protrusion 252 is moved downward farther to be positioned at space between the through hole 235 and the hooking part 225*b*. At this time, the hooking part 225*b* is elastically restituted to be positioned beyond the engaging protrusion 252, such that the engaging protrusion 252 cannot get out of the through hole 235.

Because of that, the upper frame 230, the lower frame 220 and the frame deco 250 may be secured each other smoothly as well as securely.

Here, a handle 300 is installed a front portion of the frame 210 and the user holds the handle 300 to rotate the lid 130.

Figure 4:
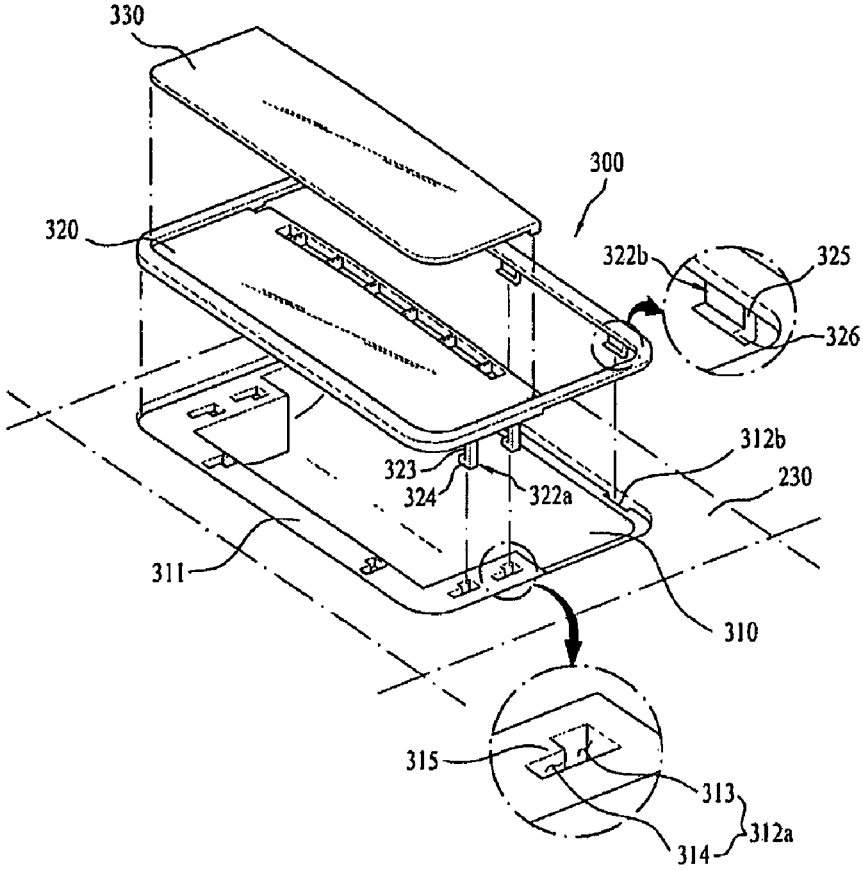
FIG. 4 is an exploded perspective view illustrating a handle provided at the lid shown in FIG. 2.

FIG. 4 is an exploded perspective view of the handle 300.

The handle 300 includes a recess 310 provided in the upper frame 230, a handle deco 320 covering a predetermined portion of the recess 310, secured to the upper frame, and a steel deco 330 secured to a top of the handle deco 320.

The recess forms a predetermined space capable of receiving the user's hand. A handle deco seating part 311 is formed adjacent along the recess 310, stepped downward from the upper surface of the upper frame 230, and the handle deco 320 is seated in the handle deco seating part 311.

A plurality of hook grooves may be provided at the handle deco seating part 311 and a plurality of hooks may be provided at the handle deco 320 correspondingly. As a result, the hooks are inserted the hook grooves, respectively.

The plurality of the hooks provided at the handle deco 320 include sliding hooks 322*a* and elastic hooks 322*b*, respectively. The sliding hook 322*a* is sliding into the hook groove 312 and the elastic hook 322*b* is elastically transformed to be coupled to the hook groove 312.

The plurality of the hook grooves include sliding hook grooves 312*a* formed at front portions of the handle deco seating part 311 and elastic hook grooves 312*b* formed at rear portions of the handle deco seating part 311, respectively. Here, each of the sliding hooks 322*a* is inserted in each of the sliding hook grooves 312*a* and each of the elastic hooks 322*b* is inserted in the elastic hook groove 312*b*.

The sliding hook groove 312*a* has a '¬' shape and the elastic hook groove 312*b* has a bar shape.

The sliding hook groove 312*a* includes an insertion hole 313 where the sliding hook 322*a* is inserted and a sliding part 314 where the sliding hook 322*a* inserted in the insertion hole 313 is sliding. The width of the sliding part 314 is smaller than that of the insertion hole 313 and a hooking surface 315 is formed adjacent to the sliding part 314.

The sliding hook 322*a* includes a first extending part 323 extended downward from the handle deco 320 and a second extending part 324 extended sideward from the first extending part 323. The elastic hook 322*b* includes an elastic part 325 extended downward from the handle deco 320 and a hooking protrusion 325 provided at an end of the elastic part 325 to be hooked in the elastic hook groove 312*b*.

Next, a process of the securing structure between the handle deco 320 and the handle deco seating part 311 will be described.

First, the sliding hook 322*a* is inserted in the insertion hole 313. Hence, if the handle deco 320 is pushed forward, the first extending part 325 is sliding to the sliding part 314.

Figure 5:
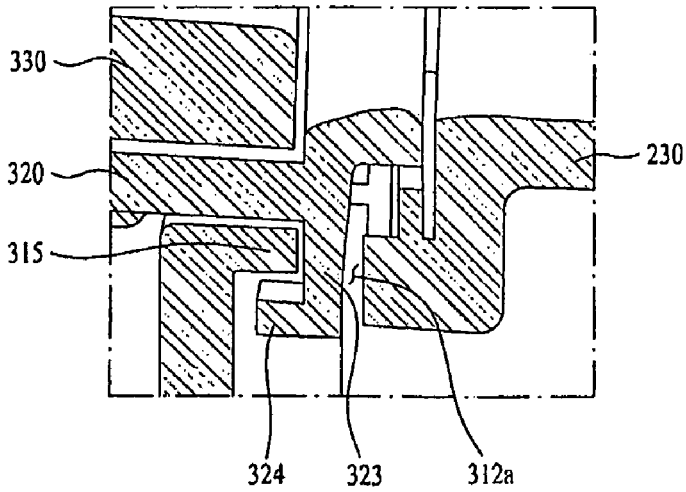
FIG. 5 is a sectional view illustrating the handle after a sliding hook provided in the handle is securely inserted in a sliding hook groove.

As shown in FIG. 5, the second extending part 324 will be positioned under the hooking surface 315 and thus the second extending part 324 is limited from moving upward.

In this state of the sliding hook 322*a* being inserted in the sliding groove 314, the elastic hook 322*b* is inserted in the elastic hook groove 312*b*. Then, the hooking surface 326 of the elastic hook 322*b* is insertedly hooked in the elastic hook groove 312*b* such that the handle deco 320 may be secured to the handle deco seating part 311 completely.

The steel deco 330 may be secured to the top of the handle deco 320 by a bonding process or a member such as a hook.

Hence, the user rotates the lid 130, the lid 130 is rotated with respect to the top cover 120 to approximately 150 degree and the opening 121 formed at the top cover 120 is open. At this time, the upper surface of the transparent member 200 is facing the upper surface of the top cover 120.

In case that the user repeats such the opening/closing of the lid 130, there would scratches on the transparent member 2000 and then the external beauty of the washing machine would deteriorate.

Figure 6:
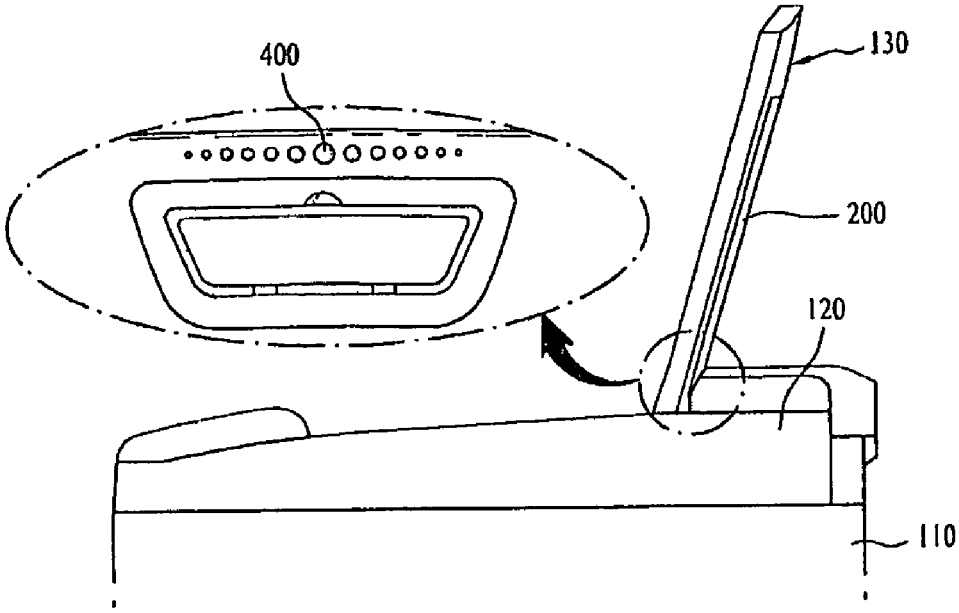
FIG. 6 is a side sectional view illustrating a plurality of projections formed at the top cover.

To prevent such the scratches generated on the transparent member 200, as shown in FIG. 6, a plurality of projections 400 may be provided at the top cover 120 and the projections 400 is formed in a water drop shape, with a convex front portion.

Since the water drop-shaped projections 400 are provided at the top cover 120, the transparent member 200 contact with the projections 400 when the user rotates the lid 130. That is, the projections 400 are in point contact with the projections 400 and scratches which might be generated at the transparent member 200 may be prevented.

Figure 7:
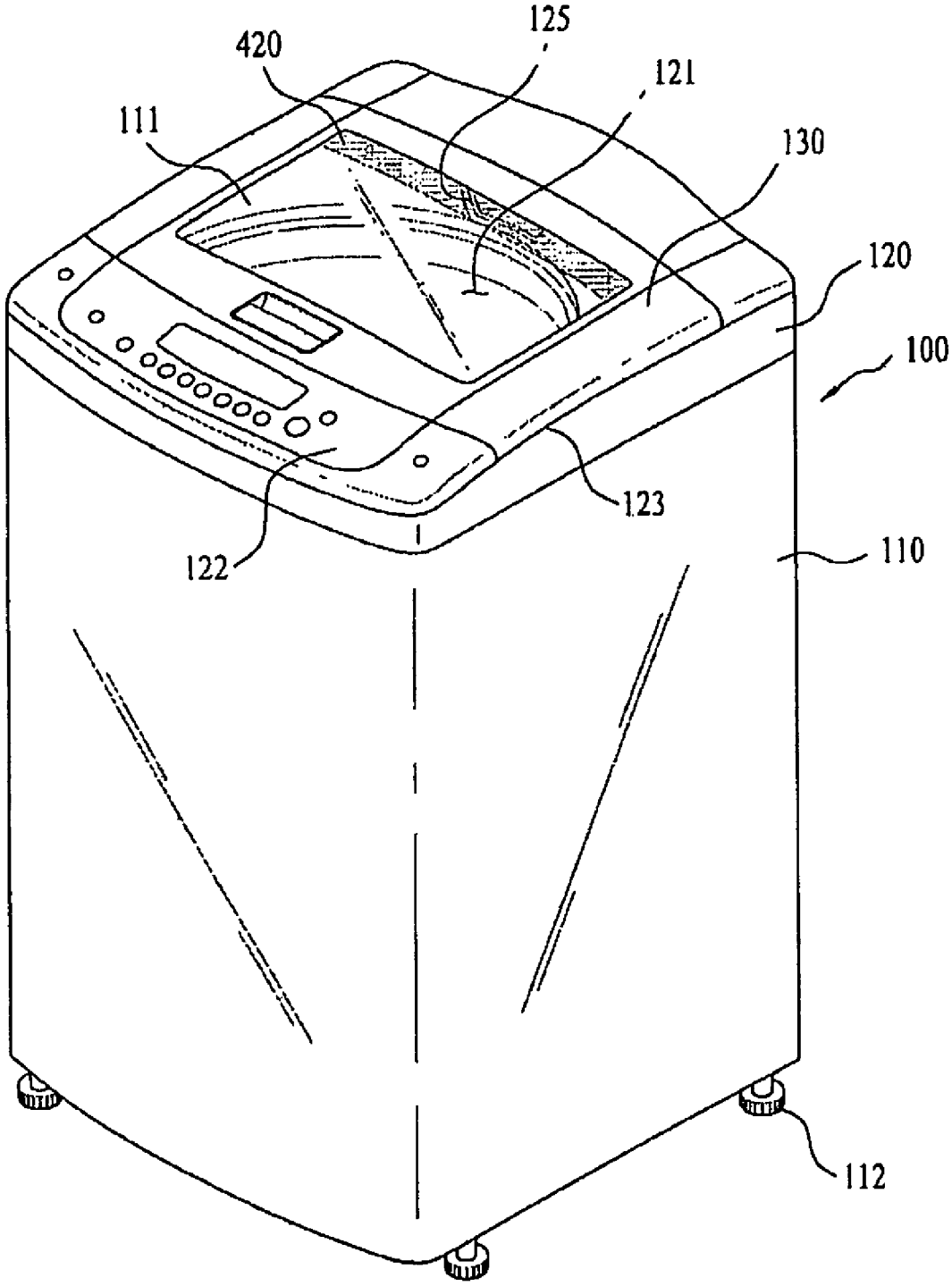
FIG. 7 is a perspective view illustrating a protection surface formed at a transparent member of the lid.

As shown in FIG. 7, without the projections 400 formed at the top cover 120, a protection surface 420 may be formed at a predetermined portion of the transparent member 200 to protect the transparent member 200. The protection surface 420 may be formed at a surface of the transparent member 200, which will contact with the top cover. It is preferable that the protection surface 420 is opaque.

According to the washing machine described above, the upper frame 230 and the lower frame 220 can be coupled only using the hook. As a result, the assembly efficiency of the product may be enhanced and the production cost thereof may be reduced.

Furthermore, the transparent member 200 provided in the lid 130 may be free from scratches and the external beauty of the washing machine will maintain accordingly.

A still further, the assembly efficiency of the handle 300 provided in the lid 130 may be enhanced.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A washing machine comprising:

a cabinet;

a top cover provided at a top of the cabinet;

a lid hingedly coupled to the top cover, wherein the lid comprises a transparent member defining a center thereof, a lower frame comprising a seating part where the transparent member is seated, and an upper frame coupled to the lower frame to support the transparent member; and a frame deco secured to the upper frame such that the lid is balanced with the top cover when the lid is secured to the top cover, wherein the lower frame comprises a first hook projected upward and the upper frame comprises a through hole where the first hook passes, and wherein the frame deco comprises an engaging protrusion engaged to the first hook.

2. The washing machine of claim 1, wherein the first hook comprises a supporting part extended upward from the lower frame and a hooking part provided at an end of the supporting part.

3. The washing machine of claim 2, wherein the hooking part is spaced apart a predetermined distance from an upper end of the through hole when the first hook passes the through hole.

4. The washing machine of claim 3, wherein the thickness of the engaging protrusion is substantially identical to the distance between the hooking part and the upper end of the through hole.

5. The washing machine of claim 1, wherein the frame deco comprises a second hook projected downward and the upper frame comprises a hooking hole where the second hook is insertedly hooked.

6. The washing machine of claim 1, wherein a handle is provided at the lid for a user to rotate the lid with respect to the top cover.

7. The washing machine of claim 6, wherein the handle comprises a recess formed at the upper frame, a handle deco hooked to an upper portion of the recess and a steel deco secured to an upper portion of the handle deco.

8. The washing machine of claim 7, wherein a handle deco seating part is formed adjacent along the recess and a plurality of hook grooves are provided at the handle deco seating part.

9. The washing machine of claim 8, wherein the handle deco comprises a sliding hook sliding into the hook groove and an elastic hook elastically transformed to be coupled to the hook groove.

10. The washing machine of claim 9, wherein each of the plurality of the elastic hook grooves comprises a sliding hook groove where the sliding hook is inserted and an elastic hook groove where the elastic hook is inserted.

11. The washing machine of claim 10, wherein the sliding hook comprises a first extending part extended downward from the handle deco and a second extending part extended horizontally from the first extending part.

12. The washing machine of claim 10, wherein the elastic hook comprises an elastic part extended downward from the handle deco and a hooking protrusion provided at an end of the elastic part, being hooked in the elastic hook groove.

13. The washing machine of claim 1, wherein the top cover comprises a plurality of projections provided a predetermined portion thereof in contact with the lid when the lid is opened.

14. The washing machine of claim 13, wherein the projection is semicircular shaped, in point contact with the lid when the lid is opened.

15. The washing machine of claim 1, wherein a protection surface is formed at a predetermined portion of the transparent member which contacts with the top cover when the lid is opened.

* * * * *